US007080802B2

(12) United States Patent
Bayer et al.

(10) Patent No.: US 7,080,802 B2
(45) Date of Patent: Jul. 25, 2006

(54) CONDUIT UNCOILER

(75) Inventors: Larry P. Bayer, 4580 Church Dr., West Bend, WI (US) 53095; Kenny Baus, Hartford, WI (US)

(73) Assignee: Larry P. Bayer, West Bend, WI (US)

( * ) Notice: Subject to any disclaimer, the term of this patent is extended or adjusted under 35 U.S.C. 154(b) by 156 days.

(21) Appl. No.: 10/726,045

(22) Filed: Dec. 2, 2003

(65) Prior Publication Data

US 2005/0116083 A1 Jun. 2, 2005

(51) Int. Cl.
*B65H 23/06* (2006.01)
*B65H 27/00* (2006.01)

(52) U.S. Cl. ..... 242/423.1; 242/129; 242/397; 242/401; 242/403; 242/407.1; 242/566; 242/607.1

(58) Field of Classification Search ..... 242/129, 242/400, 401, 403, 407.1, 566, 597.7, 607.1, 242/423, 423.1, 423.2, 397
See application file for complete search history.

(56) References Cited

U.S. PATENT DOCUMENTS

| | | | |
|---|---|---|---|
| 80,664 | A | 8/1868 | Porter et al. |
| 1,018,550 | A | 2/1912 | Brearey |
| 1,282,529 | A | 10/1918 | Blease et al. |
| 1,310,741 | A | 7/1919 | Cook |
| 1,539,016 | A | 5/1925 | Mizuno |
| 2,033,640 | A | 3/1936 | Mears |
| 2,057,728 | A | 10/1936 | Lester |
| 2,246,713 | A | 6/1941 | Benson |
| 2,254,468 | A | 9/1941 | Benson |
| 2,314,619 | A | 3/1943 | Hess |
| 2,479,415 | A | 8/1949 | Sarlo |
| 2,532,185 | A | 11/1950 | Nicholas |
| 2,545,744 | A | 3/1951 | Nell |
| 2,573,636 | A | 10/1951 | Wilson |
| 2,620,144 | A | 12/1952 | Cloud |
| 2,621,868 | A | 12/1952 | Clark et al. |
| 3,556,431 | A | 1/1971 | Freitag |
| 3,815,842 | A | 6/1974 | Scrogin |
| 4,953,810 | A | 9/1990 | Stadig |
| RE34,376 | E | 9/1993 | Branback |
| 6,305,637 | B1 | 10/2001 | Back |
| 6,655,627 | B1 * | 12/2003 | Patton ..... 242/397.2 |

FOREIGN PATENT DOCUMENTS

| | | |
|---|---|---|
| DE | 3527867 | 4/1987 |
| DK | 56529 | 8/1939 |
| FR | 2675788 | 10/1992 |
| GB | 709598 | 5/1954 |

OTHER PUBLICATIONS

Wirsbro product brochure (Jul. 2003).
Honold & La Page, Inc. product brochure (Jul. 2003).
Raupex product brochure (Jul. 2003).

* cited by examiner

*Primary Examiner*—John Q. Nguyen
(74) *Attorney, Agent, or Firm*—Ryan Kromholz & Manion, S.C.

(57) ABSTRACT

A conduit uncoiler assembly provides a mast carried by a base. The mast includes a central post carrying a plurality of radially extending support arms that support the bottom or base of the coiled conduit. Each support arm carries a radially extending retaining arm for supporting the inner diameter of the coil. The mast also carries at least one guide bar that continuously and automatically supports the top surface of the coil as the conduit is unwound. The system provides and maintains support to the bottom, top, and inner circumference of the coil as the conduit is unwound.

14 Claims, 10 Drawing Sheets

CONDUIT UNCOILER

FIELD OF THE INVENTION

The invention relates to apparatus for holding and selectively unwinding or uncoiling a length of conduit.

BACKGROUND OF THE INVENTION

Long lengths of plumbing conduit, e.g., PEX tubing, are typically transported in a coiled or wound condition to and from construction or other work sites. At the work site, the coiled length of conduit must be unwound for use. It is often necessary to stabilize and support the top, bottom, and inner circumference of the conduit as it is unwound or uncoiled to prevent twisting or kinking of the conduit. Because the working length of conduit is large and heavy, this typically requires more than one individual to support and unwind the conduit or the use of a mechanical uncoiler assembly.

Conventional uncoiler assemblies for dispensing conduit are large, cumbersome units that require a significant amount of storage space and are not readily portable. In many cases, the assembly must be disassembled for transport and storage and reassembled at the work site for use. This can be a tedious and time-consuming task. Further, most conventional systems only support the bottom and top or the bottom and inner circumference of the conduit. These systems may also require operator intervention to adjust the system to maintain suitable support. This permits the conduit move on the assembly, allowing the conduit to twist or kink as it is unwound.

The need remains for portable systems for securing and uncoiling a length of conduit that are easily assembled and disassembled and require minimal storage space. The need also remains for systems for securing and uncoiling conduit that require minimal operator intervention.

SUMMARY OF THE INVENTION

The invention provides an assembly for securing and unwinding a length of coiled conduit. The assembly provides a mast carried by a base. The mast includes a central post carrying a plurality of radially extending support arms that support the bottom or base of the coiled conduit. Each support arm carries a radially extending retaining arm for supporting the inner diameter of the coil. The mast also carries at least one guide bar that supports the top surface of the coil as the conduit is unwound. The system provides and maintains support to the bottom, top, and inner circumference of the coil as the conduit is unwound.

According to one aspect of the invention, the mast includes a post coupleable to the base. The mast includes a support arm coupled to the post to extend radially from the post. A retaining arm is coupled to the support arm to extend radially from the support arm. The support arm and the retaining arm support the length of conduit.

In one embodiment, the post is hingedly coupled to the base so as to be selectively pivotable between a collapsed condition for storage and an upright position in which the post extends radially from the base.

In one embodiment, the support arm is hingedly coupled to the post to be selectively pivotable between a collapsed condition in which the support arm is coaxial with the post and an extended condition in which the support arm extends radially from the post.

In one embodiment, the retaining arm is hingedly coupled to the support arm to be selectively pivotable between a collapsed condition in which the retaining arm is coaxial with the support arm and an extended condition in which the retaining arm extends radially from the support arm.

Another aspect of the invention provides that the base is sized and configured to engage a lid to form a housing for containing the mast. In one embodiment, a guide stand is coupleable to the housing and includes a guide window sized and configured for passage of the conduit.

Another aspect of the invention provides a guide bar sized and configured for passage over the post to rest on and support the length of conduit. In one embodiment, the guide bar includes a direction control device to permit movement of the guide bar in one direction along the post while preventing movement of the guide bar in the opposite direction along the post. In one embodiment, the direction control device is a pipe clamp.

Another aspect of the invention provides a self-contained apparatus for holding and uncoiling a length of conduit. The apparatus provides a case comprising a base and a lid. A mast having a post is coupled to the base. The mast includes a support arm coupled to the post to extend radially from the post and a retaining arm coupled to the support arm to extend radially from the support arm. The support arm and the retaining arm supporting the length of conduit. The mast has a collapsed condition for storage within the case and an assembled position for use. The base forms a free-standing platform for supporting the mast in the assembled position. A guide bar is sized and configured for passage over the post to rest on and support the length of conduit. The guide bar is also sized and configured for storage within the case.

According to another aspect of the invention, the apparatus further comprises a guide stand coupleable to the case and having a guide window sized and configured for passage of the conduit. The guide stand is sized and configured for storage within the case.

In one embodiment, the post is hingedly coupled to the base. In one embodiment, the support arm is hingedly coupled to the post. In yet another embodiment, the retaining arm is hingedly coupled to the support arm.

The lid may be coupleable to the base, e.g., by hinged attachment.

The case may also include wheels and/or handles for easy transport.

Another aspect of the invention provides an apparatus for holding and uncoiling a length of coiled conduit having a top surface, a bottom surface, and an inner circumference. The apparatus comprises a base and a stand coupleable to the base. The stand includes a first member adapted to continuously contact and support the bottom surface of the conduit during uncoiling, a second member adapted to continuously contact and support the top surface of the conduit during uncoiling, and a third member adapted to continuously contact and support the inner circumference of the conduit during uncoiling.

DESCRIPTION OF THE PREFERRED EMBODIMENT

Although the disclosure hereof is detailed and exact to enable those skilled in the art to practice the invention, the physical embodiments herein disclosed merely exemplify the invention which may be embodied in other specific structure. While the preferred embodiment has been described, the details may be changed without departing from the invention, which is defined by the claims.

Figure 1:
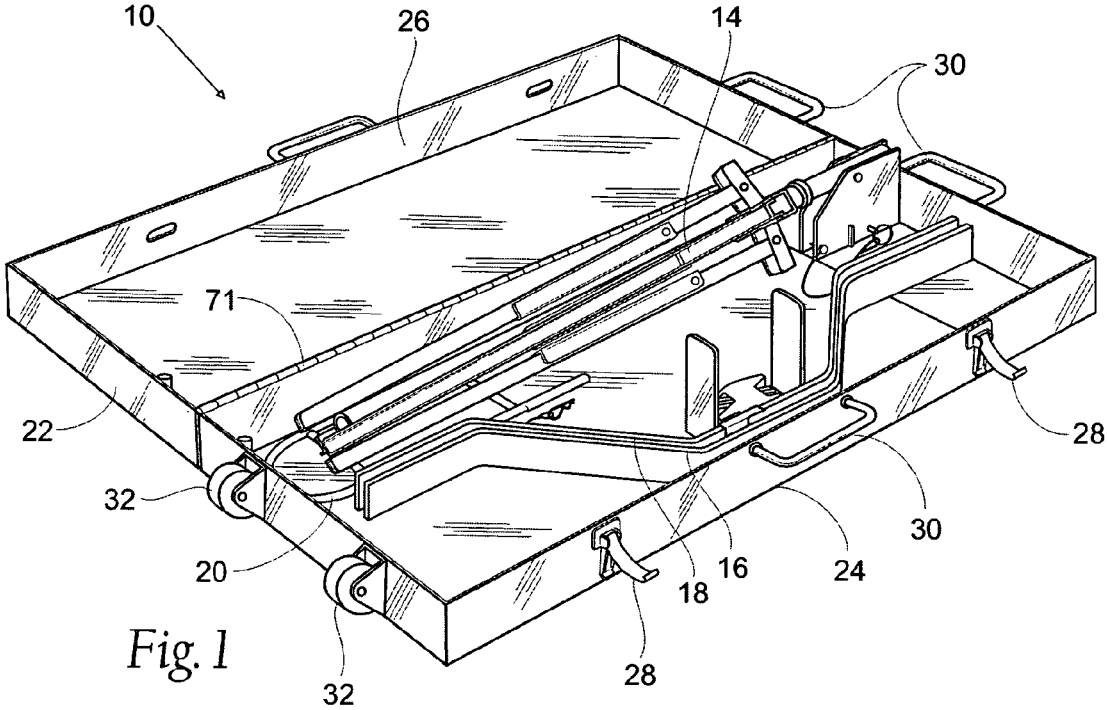
FIG. 1 is a perspective view of an assembly for holding and selectively unwinding or uncoiling a length of conduit 12.
Figure 7:
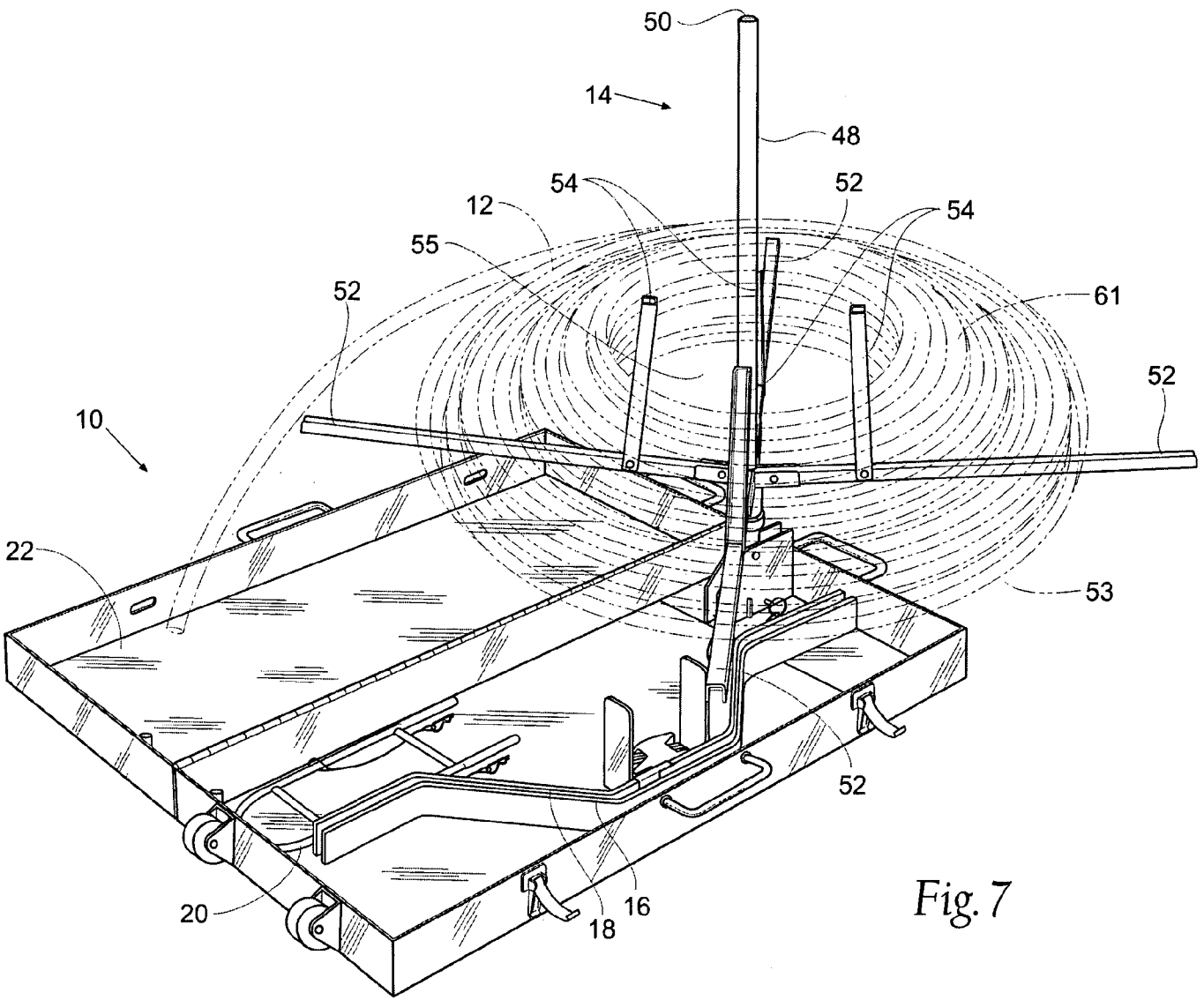
FIG. 7 is a view similar to the view shown in FIG. 6, illustrating the placement of a length of conduit on the assembly.

FIG. 1 illustrates an assembly 10 for holding and selectively unwinding or uncoiling a length of conduit 12 (see also, e.g., FIG. 7). The assembly 10 can be sized or otherwise adapted to accommodate conduit of a specific length and width. The assembly 10 is particularly well-suited for use with plumbing conduit, e.g., PEX tubing. It is contemplated, however, that the assembly 10 can be employed for use with other types of conduit 12, e.g., electrical wires or cables.

As FIG. 1 shows, the assembly 10 includes a stand or mast 14, a first guide bar 16, a second guide bar 18, and a guide stand 20 completely self-contained inside a portable housing unit or case 22. The case 22 may include compartments for receiving and securing the mast 14, bars 16 and 18, and stand 20 for storage and transport (not shown). The assembly 10 (i.e., mast 14, support bars 16 and 18, guide stand 20) and case 22 are all desirably made of a strong and durable metal suitable for supporting the weight of the conduit 12 and formed by conventional machining techniques as are well-known in the art. In a representative embodiment, the mast 14, guide bars 16 and 18, and stand 20 are made of steel which has been zinc-plated to minimize corrosion and the case 22 is made of steel and powder-coated.

Figure 2:
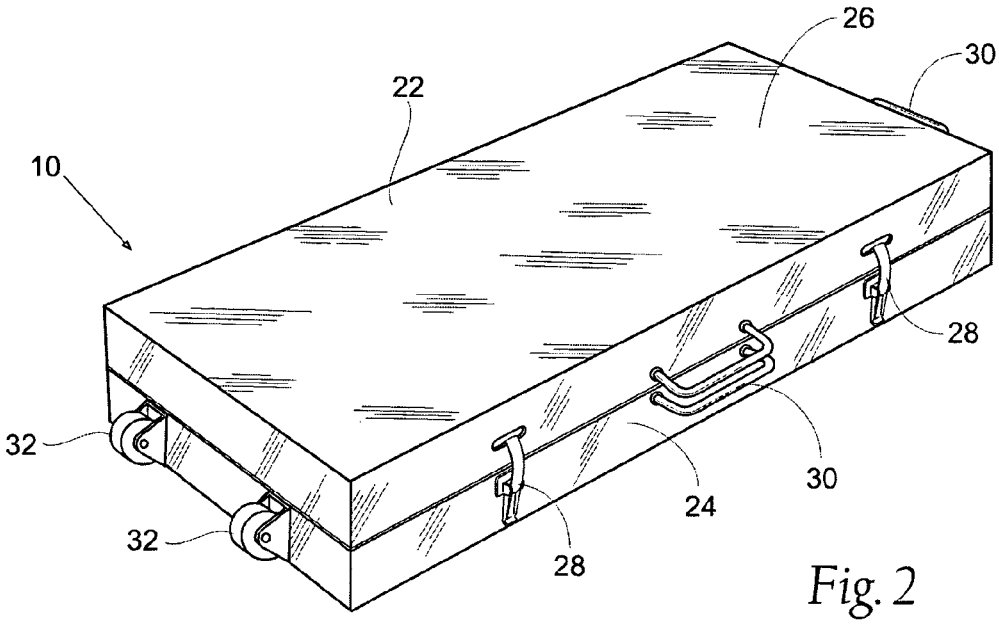
FIG. 2 is a perspective view of the assembly shown in FIG. 1, illustrating the housing in a closed condition for transport.

The case 22 includes a base 24 and a lid 26, which closes for transport, as shown in FIG. 2. In the illustrated and preferred embodiment, the lid 26 is hingedly fixed to the base 24. Alternatively, the lid 26 may be provided as a separate unit from the base 24 (not shown). The case 22 may be secured in the closed position for transport by a pair of latches 28 or any other suitable fastener or securing means. The case 22 may also be provided with handles 30 and/or wheels 32 for easy carrying and transport. It is apparent that the number and location of handles 30 and wheels 32 may vary as desired to accommodate specific needs and tasks.

With reference to FIGS. 3–7, the stand 14 includes a hollow rod 48 that is sized and configured for passage over a central post 50 and is slidable in fore and aft directions along the post 50. This arrangement permits the rod 48 to rotate in either a clockwise or counterclockwise direction relative to the post 50. Rotation of the rod 48 in a first direction serves to coil the conduit onto the mast 14 for storage and/or transport. Rotation of the rod 48 in the reverse direction serves to uncoil or unwind the conduit 12 for use. In the illustrated embodiment, the hollow tube 48 is of a shorter length than the post 50. The tube 48 is slid along the post 50 until the top of the rod 48 is approximately even with the top of the post 50. A collar 51 may be provided to prevent further advancement of the tube 48 along the rod 50. In this arrangement, the pin 34 passes only through post 50.

Figure 3:
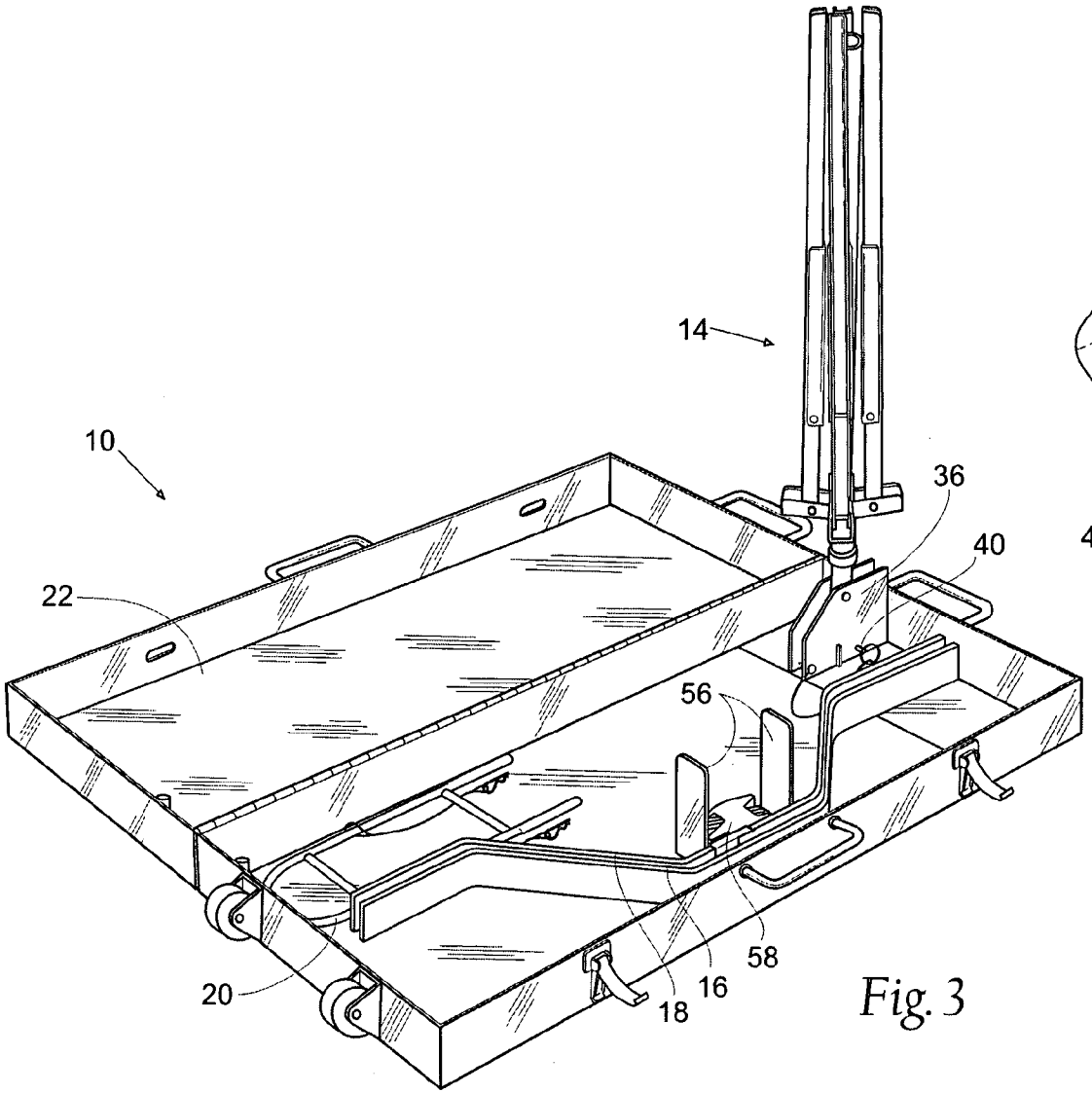
FIG. 3 is a perspective view of the assembly shown in FIG. 1, illustrating the mast in the upright position.

Post 50 is pivotally mounted within the case 22 by a pivot pin 34 so as to be selectively pivotable between a collapsed condition for storage within the case 22 (FIG. 1) and an upright position in which the post extends radially from the base 24 (FIG. 3). In use, the post 50 is pivoted within a guide frame 36 to bring the mast 14 to the upright position, as seen in FIG. 3. Desirably, the guide frame 36 is fixedly mounted within the base 24 of the case 22. This arrangement provides a self-contained system in which the base 24 of the case 22 serves as a platform for supporting the mast 14 in the upright position without the need of a separate base component.

Figure 4:
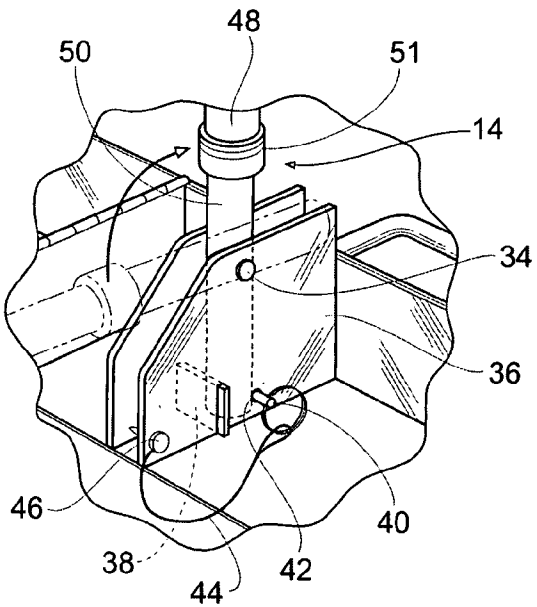
FIG. 4 is a perspective view of the mast hinge mechanism of the assembly shown in FIG. 1.

As will be apparent to one skilled in the art, a variety of means may be employed to support and stabilize the mast 14 in the upright position. By way of example and not limitation, a stop 38 can be provided to support the mast 14 in the upright position. As best seen in FIG. 4, a retaining pin 40 may also be provided to further secure and support the stand 14 in the upright position. In the illustrated embodiment, the pin 40 is sized and configured for passage through a pair of apertures 42 in the hinge frame 36. The retaining pin 40 may be tethered to the hinge frame 36 by a tether line 44 and a fastener 46 (e.g., screw) to prevent loss of the retaining pin 40.

A plurality of support arms 52 are carried by the rod 48 and hingedly attached to the rod 48. The support arms 52 are desirably hingedly fixed to the rod 48 to permit movement of the arms 52 between a first position and a second position. In the first position, the arms 52 are coaxial with the rod 48 in a folded or collapsed condition suitable for transport or storage, as seen in FIG. 3. In the second position, the arms 52 extend radially from the rod 48 for use, as shown in FIG. 5.

In the illustrated embodiment, four support arms 52 are provided and are spaced approximately equidistant around the circumferential margin of the rod 48. It is contemplated that the number and configuration of the supports arms 52 can vary to accommodate conduit 12 of specific types and sizes.

Figure 5:
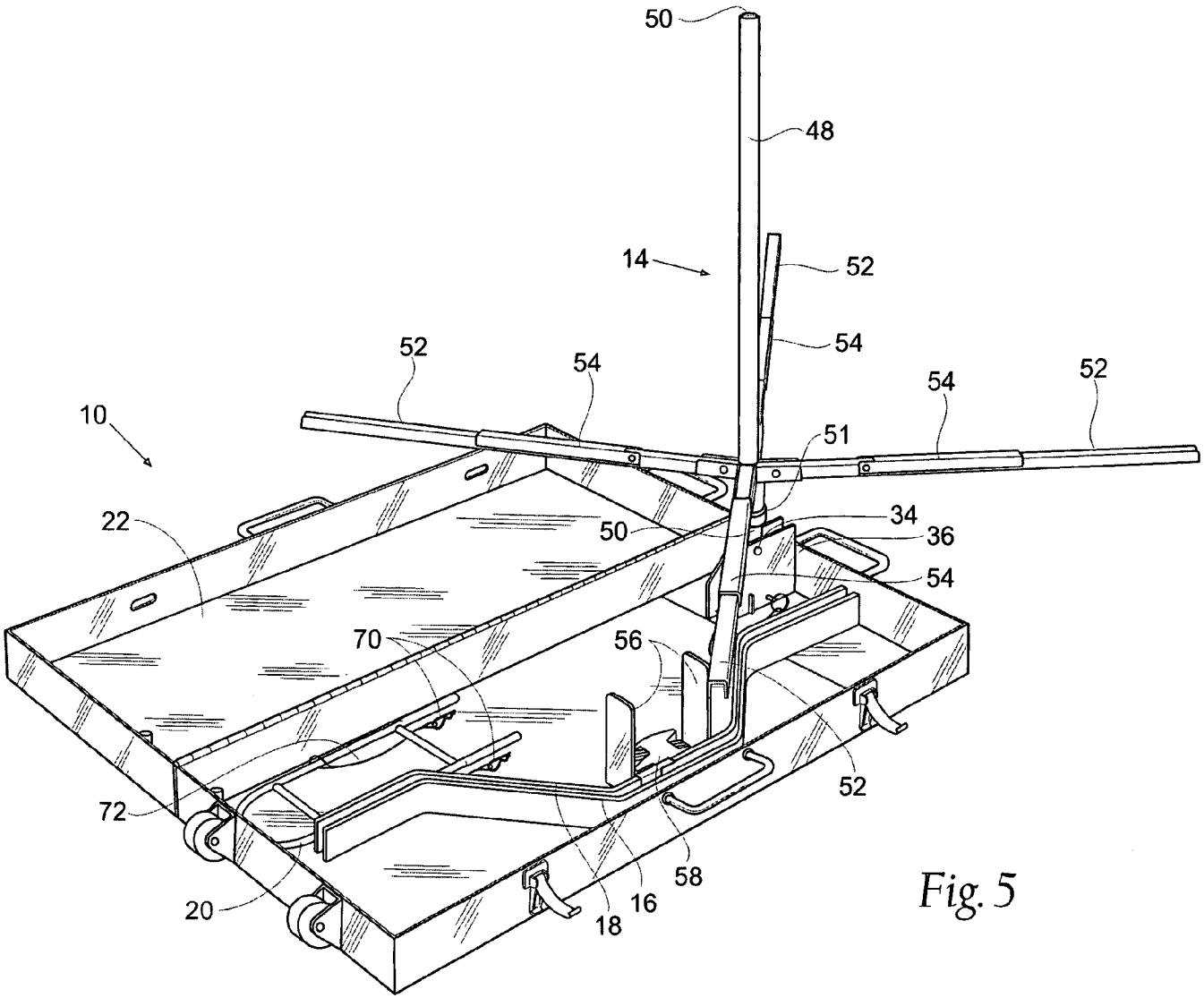
FIG. 5 is a view similar to the view shown in FIG. 3, illustrating the support arms in an upright position.
Figure 6:
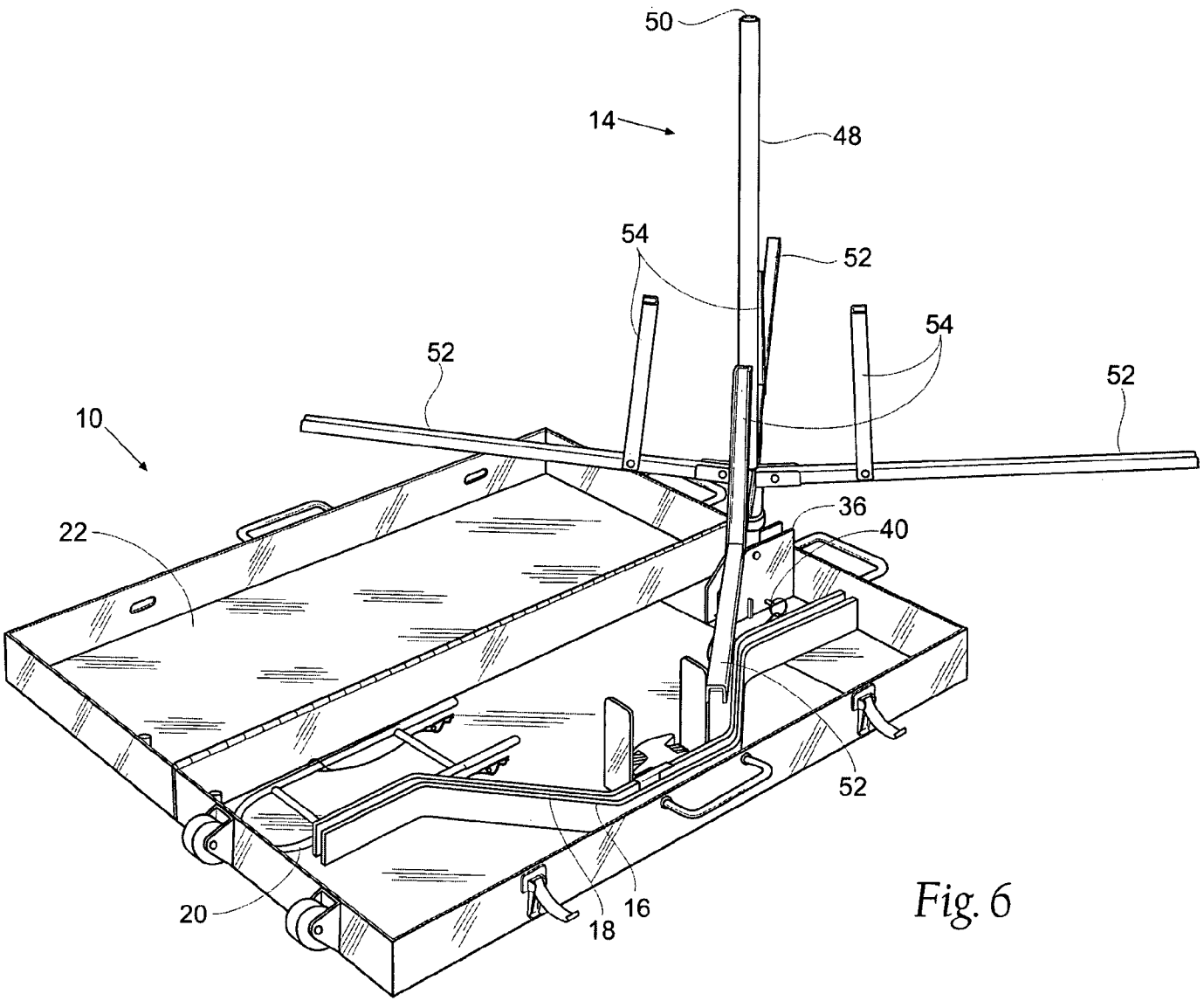
FIG. 6 is a view similar to the view shown in FIG. 5, illustrating the retaining arms in an upright position.

A retaining arm 54 is hingedly fixed to each support arm 52 and selectively pivotable between a collapsed condition in which the retaining arm 54 is coaxial with the support arm 52 (FIG. 5) and an extended condition in which the retaining arm 54 extends radially from the support arm 52 in an upright or vertical position (FIG. 6).

With reference to FIG. 5, with the mast 14 in the upright position, the support arms 52 are extended radially from the rod 48. As shown in FIG. 6, the retaining arms 54 are then extended radially from the support arms 52 in an upright position. A length of coiled conduit 12 is then placed on the stand 14. Rod 48 is rotated to coil the conduit 12 on support arms 52 and around retaining arms 54, as seen in FIG. 7. The support arms 52 support the bottom of the conduit 53 and retaining arms 54 stabilize and support the inner circumference 55 of conduit 12 on the support stand 14 while the conduit 12 is unwound or uncoiled.

Figure 8:
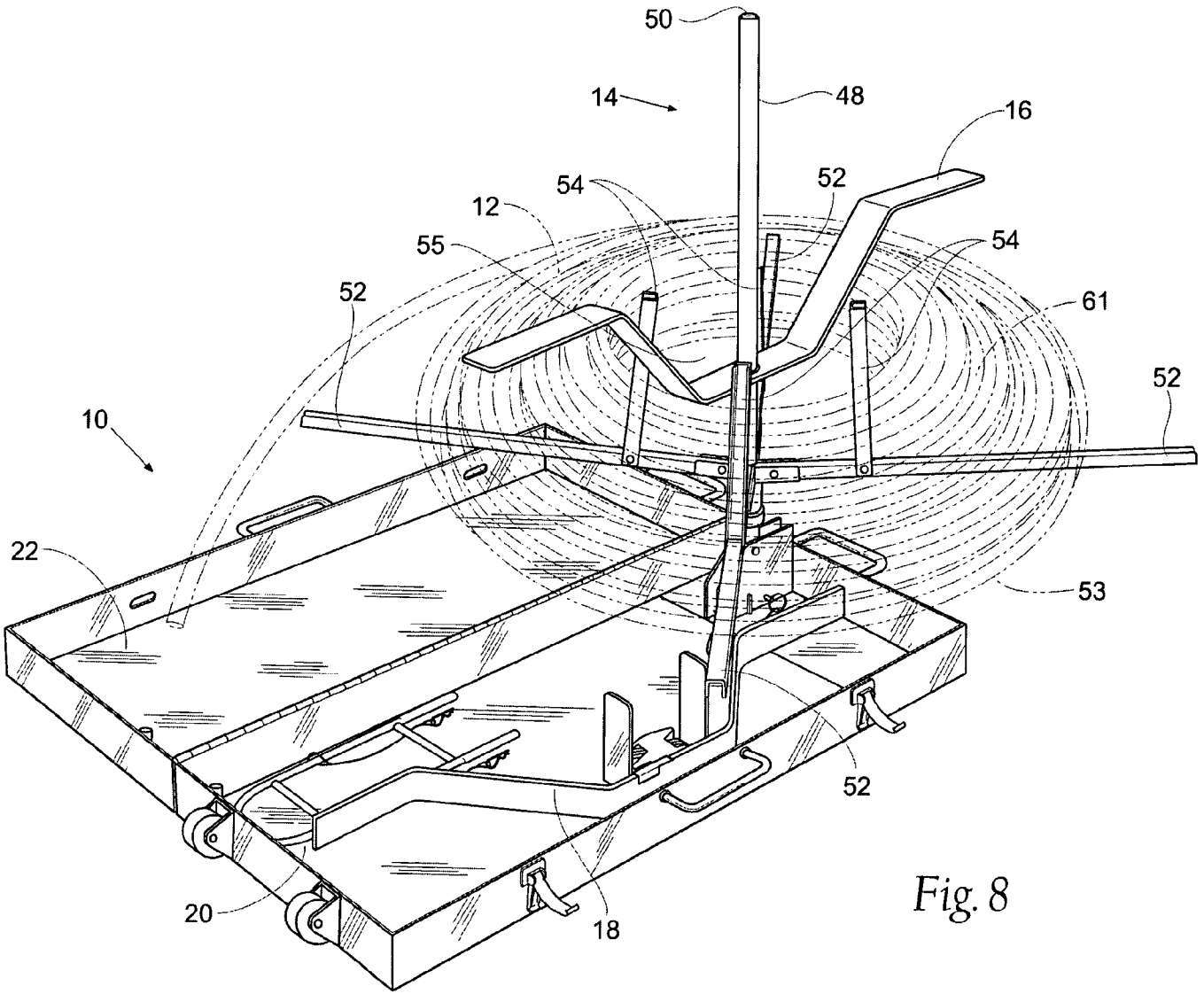
FIG. 8 is a view similar to the view shown in FIG. 7, illustrating the placement of a first support bar over the length of conduit.
Figure 9:
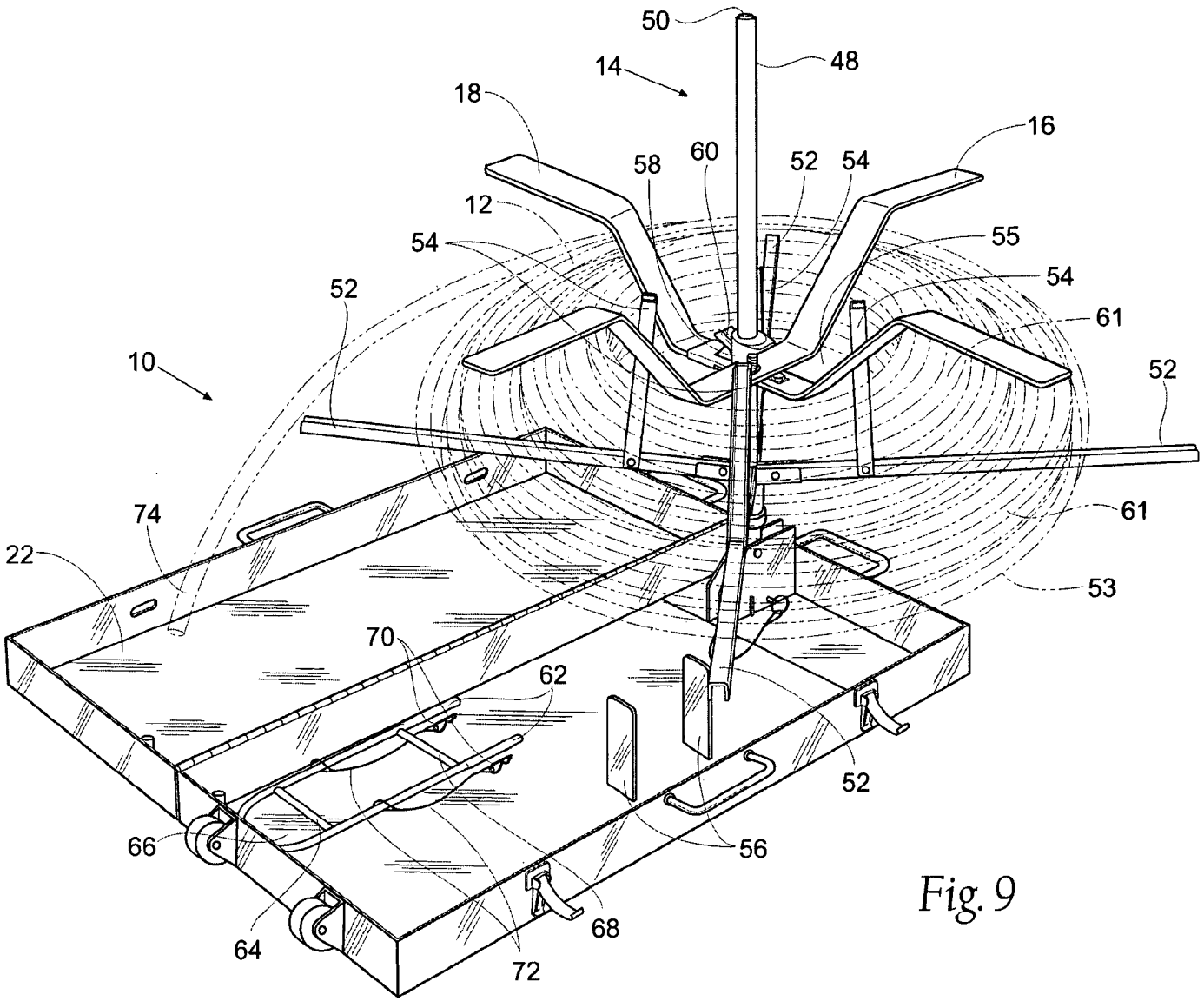
FIG. 9 is a view similar to the view shown in FIG. 8, illustrating the placement of a second support bar over the length of conduit.

With reference to FIGS. 8 and 9, the coiled conduit 12 is secured in position on the stand 14 by the first guide bar 16 and the second guide bar 18. In the illustrated embodiment, a pair of retaining brackets 56 is provided in the base 24 of the case 22 to stabilize and secure the guide bars 16 and 18 for transport (see also FIG. 3). The first bar 16 is sized and configured to pass over the rod 48 and rest on the coiled conduit 12, as FIG. 8 shows. As FIG. 9 shows, the second bar 18 is sized and configured to pass over the rod 48 and rest on the first bar 16. In a preferred embodiment, a direction control permits movement of the second guide bar 18 in one direction along the rod 48 while preventing movement of the second guide bar 18 in the opposite direction along the rod 48. In the illustrated embodiment, the direction control device takes the form of a conventional pipe clamp 58 coupled to the second guide bar 18. The direction control device 58 desirably includes a locking mechanism 60 adapted to prevent movement of the bars 16 and 18 in the reverse direction unless the locking mechanism 60 is deactivated.

With the conduit 12 in position on the stand 14, first bar 16 is passed over the rod 48 to rest on the conduit 12. The second bar 18 is then passed over the rod 48 to rest on the first rod 16. The pipe clamp 58 is adapted to permit to the bars 16 and 18 to automatically and continuously lower as the conduit 12 is uncoiled. That is, the bars 16 and 18 will remain resting on the conduit 12 without operator intervention to guide the conduit as the conduit 12 is uncoiled and secure the conduit 12 in position, thereby providing continuous support to the top 61 of the conduit 12 to prevent twisting or kinking of the conduit 12. FIG. 9 shows the bars 16 and 18 in the lowered position.

Figure 10:
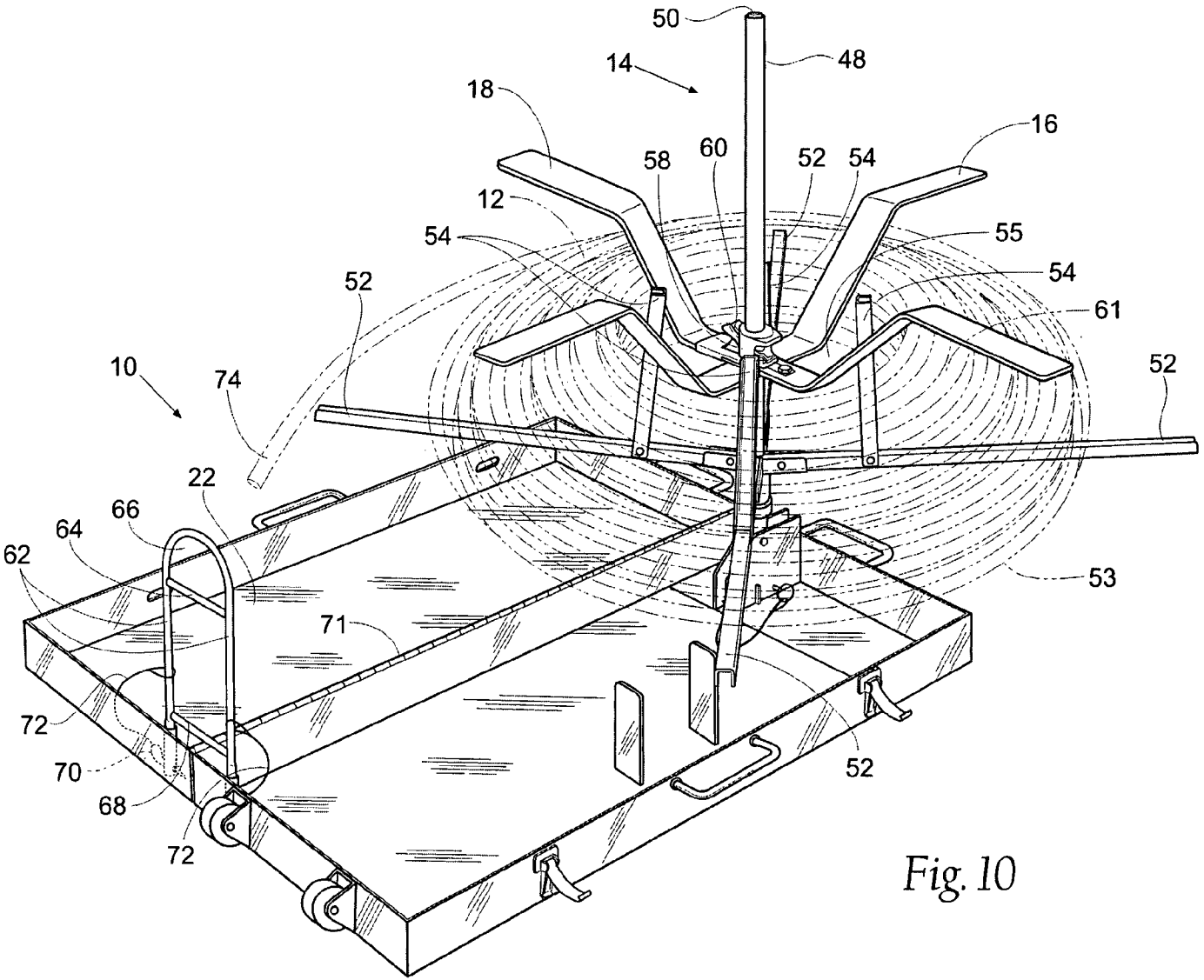
FIG. 10 is a view similar to the view shown in FIG. 9, illustrating the placement of a guide stand on the housing base.
Figure 11:
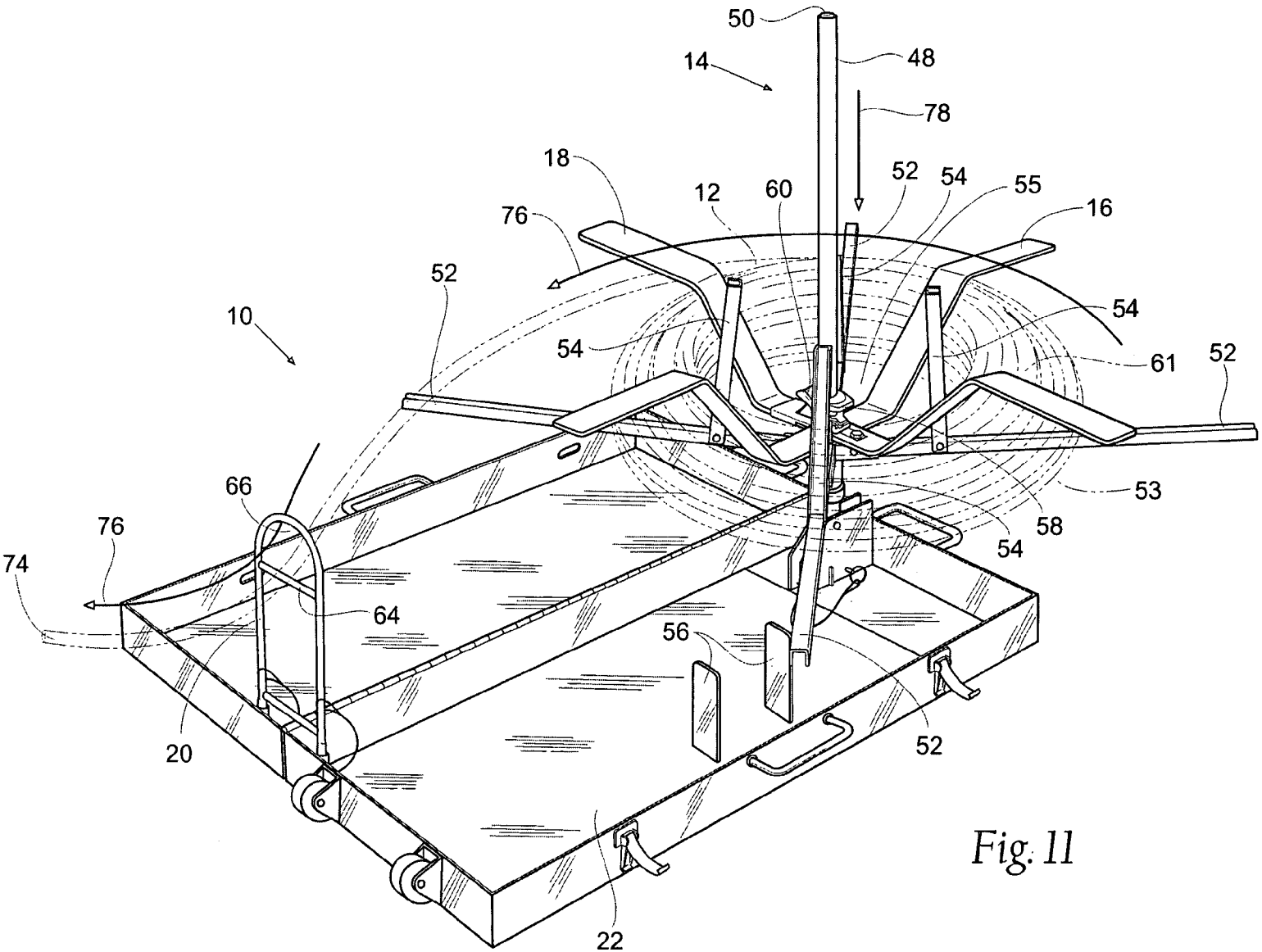
FIG. 11 is a view similar to the view shown in FIG. 10, illustrating the passage of the length of conduit through the guide stand and unwinding of the conduit.

With reference to FIGS. 10 and 11, an eyelet stand or guide stand 20 is provided to receive and guide the conduit 12 during uncoiling. In the illustrated embodiment, the stand 20 includes a pair of legs 62 that support an eyelet crossbar 64 defining an eyelet window 66. The eyelet window 66 serves to receive and guide the conduit 12 as it is uncoiled, as best illustrated in FIG. 11. If desired, a support crossbar 68 may be provided to provide additional strength to the stand 20 and further stabilize the stand 20.

The guide stand 20 is first placed in position by placing the legs 62 within a complementary pair of retainers 70 in the case 20, as seen in FIG. 10. The retainers 70 may be carried by the lid 26 or the base 24. In the illustrated embodiment, the retainers 70 are spaced on opposing sides of the case hinge 71, such that one retainer 70 is carried by the lid 26 and the other retainer 70 is carried by the base 24. Placement of the legs 62 within the retainers 70 serves to stabilize the hinge 71 in the open position. Alternatively, both retainers 70 may be carried by the lid 26 or both retainers may be carried by the base 24.

The guide stand 20 can be further secured in place by a retaining member. The retaining member serves to stabilize the stand 20 as the conduit 12 is unwound. In the illustrated embodiment, the retaining member takes the form of a pair of retaining clips 70. It is apparent that the retaining member can also take a variety of other forms, e.g., screws. The retaining clips 70 may be tethered to the stand 20 by a tether line 72 to prevent loss of the retaining clips 70. One retaining clip 70 may be secured to each leg 62 to further secure the stand 20 in position.

Figure 12:
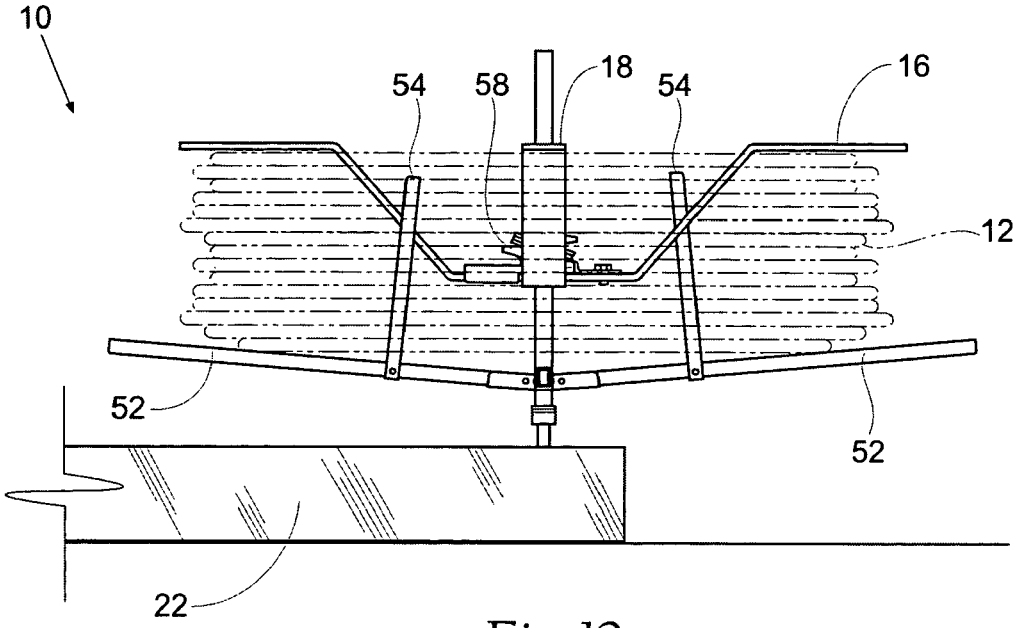
FIG. 12 is a front plan view of the mast holding a length of conduit.
Figure 13:
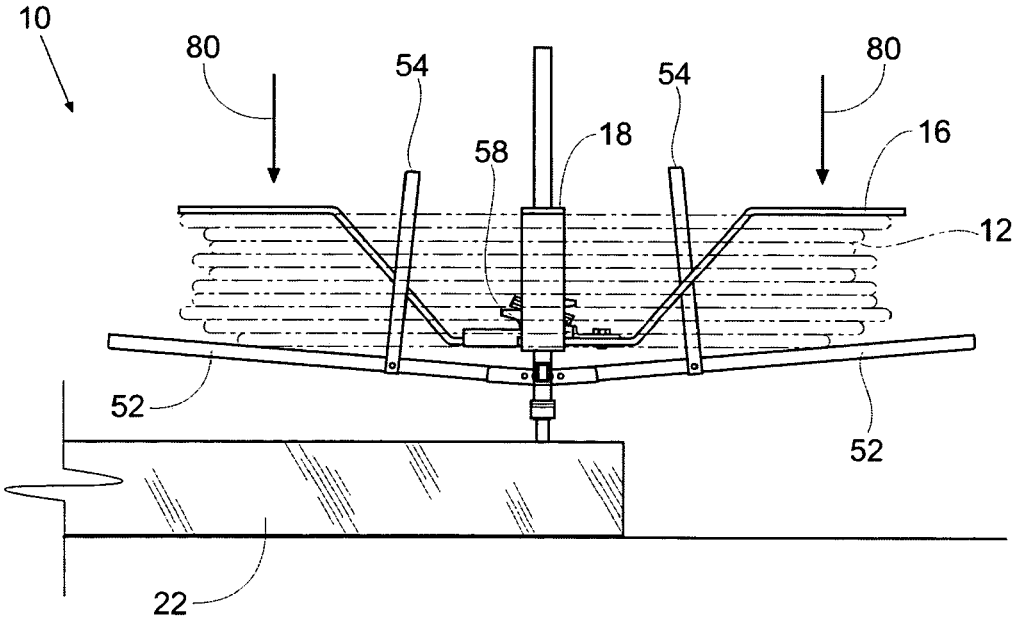
FIG. 13 is a view similar to FIG. 12, illustrating the lowering of the support arms to support the conduit as the conduit is unwound.

With reference again to FIG. 11, a free end 74 of the conduit 12 is grasped, either manually or by mechanical means, and pulled forward, thereby rotating the stand 14 (by rotation of rod 48) to unwind the conduit 12, as represented by arrows 76 in FIG. 11. As noted previously, the rod 48 rotates in either a clockwise or counterclockwise direction relative to the post 50 to permit rotation of the stand 14 and uncoiling of the conduit 12. The free end 74 of the conduit 12 is then passed through the eyelet window 66 to stabilize the conduit 12 as the conduit 12 is unwound further. As the conduit 12 is unwound, the conduit 12 is continuously advanced through the eyelet window 66. As the conduit 12 is unwound and the length of conduit 12 remaining on the stand 14 decreases, support arms 16 and 18 are automatically and continuously lowered along the stand 12 and remain resting on the conduit to provide continuous supporting contact, as represented by arrow 78 in FIG. 11. Pipe clamp 58 prevents the support arms 16 and 18 from moving in the opposite direction, i.e., from being raised along the stand 14, to thereby assure continuous supporting contact of the arms 16 and 18 with the conduit 12 as the conduit 12 uncoiled. FIG. 12 illustrates the stand 14 and the position of the support bars 16 and 18 when the stand 14 is holding a full length of conduit 12. FIG. 13 illustrates the downward or lowering movement (as represented by arrows 80) of the support bars 16 and 18 as the conduit 12 is unwound.

After use, locking mechanism 58 is released and support bars 16 and 18 and any remaining conduit 12 are removed from the stand 14. Retaining arms 54 and support arms 52 are then pivoted to the collapsed position. Post 50 is pivoted to the collapsed position to completely collapse the stand 14 within the case 22 for storage. Guide stand 20 may be removed from retainers 70 for storage with the case 22.

The foregoing is considered as illustrative only of the principles of the invention. Furthermore, since numerous modifications and changes will readily occur to those skilled in the art, it is not desired to limit the invention to the exact construction and operation shown and described. While the preferred embodiment has been described, the details may be changed without departing from the invention, which is defined by the claims.

We claim:

1. An apparatus for holding and uncoiling a length of conduit comprising a base, a mast having a post coupled to the base so as to extend radially from essentially perpendicular to the base, the mast including a support arm coupled to the post to extend radially from essentially perpendicular to the post, and a retaining arm coupled to the support arm to extend radially from essentially perpendicular to the support arm, the support arm and the retaining arm supporting the length of conduit, and a guide bar sized and configured for passage over the post to rest on and support the length of conduit, the guide bar including a direction control device to permit movement of the guide bar in one direction along the post while preventing movement of the guide bar in the opposite direction along the post.

2. An apparatus as in claim 1 wherein the post is hingedly coupled to the base so as to be selectively pivotable between a collapsed condition for storage and an upright position in which the post extends radially from essentially perpendicular to the base.

3. An apparatus as in claim 1 wherein the support arm is hingedly coupled to the post to be selectively pivotable between a collapsed condition in which the support arm is coaxial with the post and an extended condition in which the support arm extends radially from essentially perpendicular to the post.

4. An apparatus as in claim 1 wherein the retaining arm is hingedly coupled to the support arm to be selectively pivotable between a collapsed condition in which the retaining arm is coaxial with the support arm and an extended condition in which the retaining arm extends radially from essentially perpendicular to the support arm.

5. An apparatus as in claim 1 wherein the base is sized and configured to engage a lid to form a housing for containing the mast.

6. An apparatus as in claim 5, further comprising a guide stand coupleable to the housing and having a guide window sized and configured for passage of the conduit.

7. An apparatus as in claim 1 wherein the direction control device is a pipe clamp.

8. An apparatus for holding and uncoiling a length of coiled conduit, the coiled conduit having a top surface, a bottom surface, and an inner circumference, the apparatus comprising a base, and a stand coupleable to the base, the stand comprising (a) a first member adapted to continuously contact and support the bottom surface of the conduit during uncoiling, (b) a second member adapted to continuously contact and support the top surface of the conduit during uncoiling, the second member including a direction control device to permit movement of the second member in one direction while preventing movement of the second member in the opposite direction, and (c) a third member adapted to continuously contact and support the inner circumference of the conduit during uncoiling.

9. An apparatus as in claim 8 wherein the stand is hingedly coupled to the base.

10. An apparatus for holding and uncoiling a length of conduit comprising a base, a mast having a post coupled to the base so as to extend essentially perpendicular to the base, wherein the post is hingedly coupled to the base so as to be selectively pivotable between a collapsed condition for storage and an upright position in which the post extends essentially perpendicular to the base, the mast including:

(a) a support arm hingedly coupled to the post to be selectively pivotable between a collapsed condition in which the support arm is coaxial with the post and extends, at least in part, beside and essentially parallel to the post and an extended condition in which the support arm extends essentially perpendicular to the post, (b) a retaining arm hingedly coupled to the support arm to be selectively pivotable between a collapsed condition in which the retaining arm is coaxial with the support arm and extends, at least in part, beside and essentially parallel to the support arm and an extended condition in which the retaining arm extends essentially perpendicular to the support arm, the support arm and the retaining arm supporting the conduit, and (c) a guide bar sized and configured for passage over the post to rest on and support the length of conduit, said guide bar including a direction control device to permit movement of the guide bar in one direction along the post while preventing movement of the guide bar in the opposite direction along the post.

11. An apparatus as in claim 10 wherein the post is hingedly coupled to the base so as to be selectively pivotable between a collapsed condition for storage and an upright position in which the post extends radially from essentially perpendicular to the base.

12. An apparatus as in claim 10 wherein the base is sized and configured to engage a lid to form a housing for containing the mast.

13. An apparatus as in claim 12, further comprising a guide stand coupleable to the housing and having a guide window sized and configured for passage of the conduit.

14. An apparatus as in claim 10 wherein the direction control device is a pipe clamp.

* * * * *